US007631363B2

(12) United States Patent
Myerscough

(10) Patent No.: US 7,631,363 B2
(45) Date of Patent: Dec. 15, 2009

(54) SPLIT SKIN DRY-SUIT

(75) Inventor: Richard Kerr Myerscough, Victoria (CA)

(73) Assignee: Whites Manufacturing Ltd., Saanichton, BC (CA)

( * ) Notice: Subject to any disclaimer, the term of this patent is extended or adjusted under 35 U.S.C. 154(b) by 68 days.

(21) Appl. No.: 11/621,641

(22) Filed: Jan. 10, 2007

(65) Prior Publication Data

US 2007/0186326 A1 Aug. 16, 2007

Related U.S. Application Data

(60) Provisional application No. 60/772,864, filed on Feb. 14, 2006.

(51) Int. Cl.
*B63C 11/04* (2006.01)

(52) U.S. Cl. ..... 2/2.15

(58) Field of Classification Search ..... 2/228, 2/67, 69, 79, 82, 223, 2.15, 2.16, 220, 238, 2/235–237

See application file for complete search history.

(56) References Cited

U.S. PATENT DOCUMENTS 4,023,223 A * 5/1977 Anderson et al. ..... 441/104
4,276,341 A 6/1981 Tanaka
4,293,957 A 10/1981 Melarvie
4,483,019 A * 11/1984 Spangrud et al. ..... 2/2.16
4,667,344 A * 5/1987 Cooper, III ..... 2/79
5,631,074 A * 5/1997 Herlihy, Jr. ..... 442/35
5,918,314 A * 7/1999 Moses ..... 2/79
6,371,977 B1 * 4/2002 Bumbarger et al. ..... 607/108
6,415,449 B2 7/2002 Duplock
6,519,774 B2 * 2/2003 Mitchell ..... 2/2.15
6,715,149 B2 4/2004 Myerscough
7,051,375 B2 5/2006 Polak et al.
2006/0260018 A1 11/2006 Gordon et al.

FOREIGN PATENT DOCUMENTS

CA 2365264 A1 6/2003

* cited by examiner

*Primary Examiner*—Tejash Patel
(74) *Attorney, Agent, or Firm*—Oyen Wiggs Green & Mutala LLP

(57) ABSTRACT

This invention pertains to a novel dry-suit design that has a smooth elastomeric outer shell which envelopes a separate element proof inner shell. The dry-suit has a smooth integral outer appearance thereby enabling ready movement and comfortable use by a wearer.

23 Claims, 3 Drawing Sheets

SPLIT SKIN DRY-SUIT

This application claims Convention priority on U.S. provisional patent application Ser. No. 60/772,864, filed Feb. 14, 2006.

FIELD OF THE INVENTION

This invention relates to a novel design of double layer (split-skin) dry-suit, useful for underwater diving or water surface activities.

BACKGROUND OF INVENTION

Fabric-based underwater diving or water surface activity dry-suits have been manufactured by the basic processes of heat seaming and stitching over several decades. To provide the user with ease of motion and the ability to access and remove the suits under severe conditions, dry-suits have traditionally been made from a bulky fabric that has an area that is well in excess of the area required to cover the body of the user. All seams of the dry-suit are sealed. Because excess fabric is used, the excess fabric tends to collect and crease at the flex points of the dry-suit such as the shoulders, armpits, neck, waist, knees and crotch areas. This causes discomfort to the wearer of the dry-suit, especially at greater water depths where the hydrostatic water pressure forces the folds and creases against the body of the wearer at the respective flex points. The accumulation of excess fabric at critical points can also create a safety hazard because the excess fabric can interfere with mobility and the operation of equipment used by the diver. Excess fabric also impedes progress because it creates drag resistance in the water.

Melarvie (U.S. Pat. No. 4,293,957, granted 13 Oct. 1981) discloses a system for wetsuits using a stretchable panel under laid by a single attached flap to allow ease of entry and exit of the wearer into and out of the wetsuit while retaining some motion flexibility. Wetsuits are distinct from dry-suits and, unlike dry-suits, permit water to enter the space between the wetsuit and the wearer's body.

Myerscough (U.S. Pat. No. 6,715,149, granted 6 Apr. 2004) relates to a novel design of dry-suit which has a smooth captive shell and concealed pleats for improved dry-suit functionality. The dry-suit comprises a hollow element-proof fabric formed in the shape of a human body including two arms, two legs and a torso; first and second inwardly extending pleats formed in each of the two legs; and first and second elastic element-proof fabric panels covering the respective first and second pleats and sealed around the periphery with the surrounding adjacent regions of the element-proof fabric of the dry-suit.

The foregoing examples of the related art and limitations related thereto are intended to be illustrative and not exclusive. Other limitations of the related art will become apparent to those of skill in the art upon a reading of the specification and a study of the drawings.

SUMMARY OF THE INVENTION

The invention is directed to a double layer dry-suit comprising: (a) a first hollow element-proof flexible inner shell material formed in the shape of a human body including two arms, two legs and a torso; and (b) a second hollow elastic outer shell material formed in the shape of a human body including two arms, two legs and a torso overlying the first material.

The first flexible element-proof (typically waterproof) inner shell material can be formed of, but not limited to, flexible, breathable polyurethane coated nylon fabric, flexible breathable waterproof nylon fabric, elastomer coated fabric, neoprene, flexible polystyrene, latex, butadiene, polyvinyl, rubber or element-proof or waterproof Lycra fabric. The second elastic outer shell material can formed of, but note limited to, neoprene, flexible polystyrene, latex, butadiene, polyvinyl, rubber, elastic fabric or Lycra fabric.

The area of the second elastic outer material can preferably be smaller in area than the area of the first element-proof flexible material. Being smaller in area, the elastomeric action of the second elastic material can compress the underlying first element-proof flexible fabric inner material to provide a dry-suit with a smooth outer skin. The amount by which the inner material can be larger than the outer material depends upon the application of the suit.

The second outer elastic material does not necessarily have to be attached to the first inner material because the elastic action holds it onto the inner material. However, optionally, the inner element proof layer and the outer layer can be connected or secured together at appropriate locations such as the neck, wrists, abdomen, buttocks and ankles. The first and second materials can be connected together by a variety of fasteners such as, but not limited to, hook and pile fasteners, snaps, zippers, buckles, adhesives, magnets, folds, sewing, folds and roll-ups.

The dry-suit can be formed in separate sections which can be connected together. The separate sections can be formed to fit the upper body and the lower body.

Either or both of the mating surfaces of the first material and the second material can be treated with an anti-slip element to minimize shift between the two layers of material when subjected to a compressive load. The anti-slip elements would be applied to one or both of the contacting sides of the two layers of material. The anti-slip elements can consist of but not be limited to sticky inks and detachable adhesives.

The invention is also directed to a method of constructing a dry-suit comprising: (a) preparing a first hollow element-proof flexible material in the shape of a human body including two arms, two legs and a torso; (b) preparing a second hollow elastic material in the shape of a human body including two arms, two legs and a torso; and (c) overlying the second material on the first material. Optionally, the first flexible material can be connected to the second elastic material at the neck, wrist and ankle areas of the dry-suit, or other suitable areas. Connection can be made by suitable sealing materials, stitching, zippers or hook and pile fasteners.

The elastomeric action of the second hollow elastic material can compress the underlying first element-proof fabric to provide a smooth body confirming dry-suit, and squeeze out any water or the like that is collected in the space between the first and second materials, and also squeeze out any excess air that might be trapped between the inner layer and the user's body.

The method can include applying to the seat or chest area of the material facing surface of either the first material or the second material, or both, a detachable adhesive or a sticky ink.

BRIEF DESCRIPTION VIEWS OF THE DRAWINGS

Exemplary embodiments are illustrated in referenced figures of the drawings. It is intended that the embodiments and figures disclosed herein are to be considered illustrative rather than restrictive.

Figure 3A:
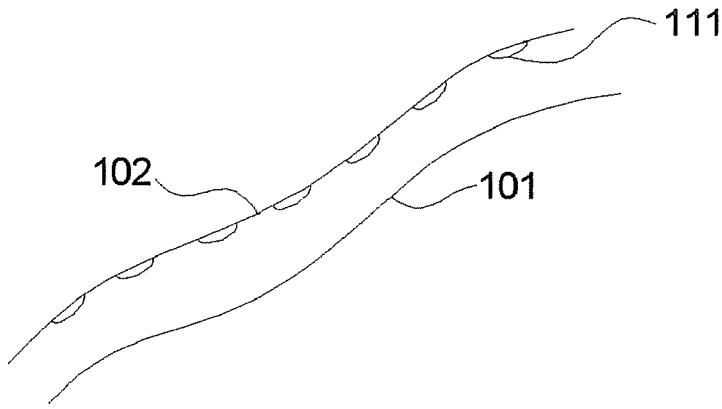
Figure 3B:
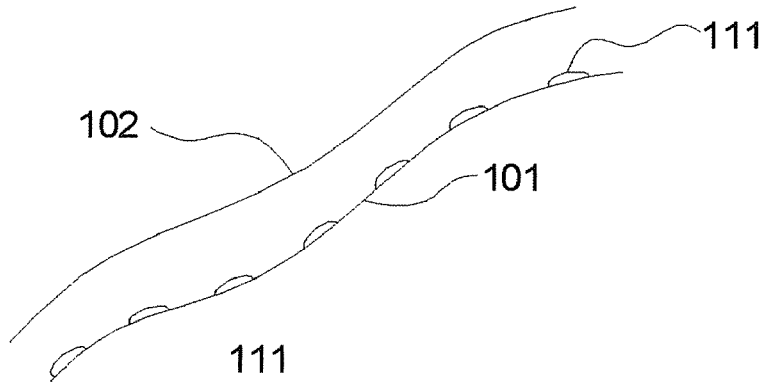
Figure 3C:
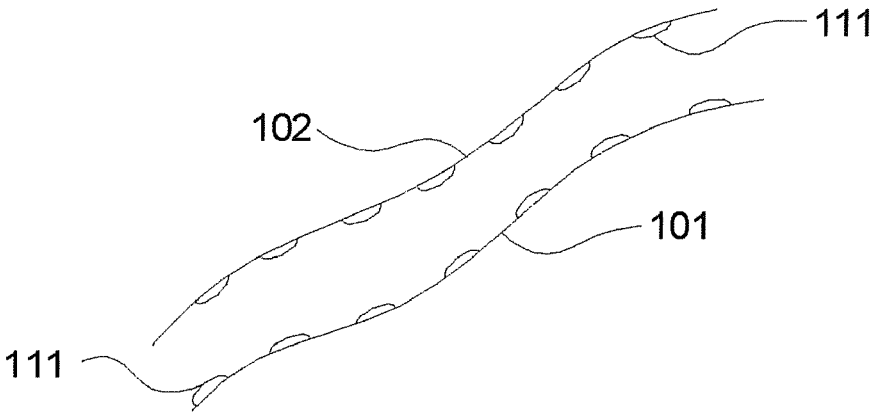

FIGS. 3*a*, 3*b* and 3*c* respectively illustrate side views of the interior side of a section of elastic outer material with spatially disposed anti-slip elements, the exterior side of the inner material with spatially disposed anti-slip elements, or both the interior sides of the outer material and the exterior side of the inner material with spatially disposed anti-slip elements.

DETAILED DESCRIPTION OF THE INVENTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

The subject invention discloses a novel design of a double layer dry-suit that closely fits the body of the wearer and allows increased mobility and comfort. This is a prime advantage because the reduction of bulky areas in the dry-suit, when in use, translates directly to the safety of the wearer. The outer surface of the dry-suit according to the invention is smooth and streamlined in construction compared to conventional bag style dry-suits. This minimizes motion resistance in the water. Swimming is easier and less effortful. The dry-suit according to the invention is typically used by divers, kite-boarders, surfers, windsurfers or anyone that requires protection from the elements, usually water, particularly cold water.

The dry-suit according to the invention, in a preferred embodiment, comprises: (a) an inner shell in the form of a hollow element-proof fabric that has the shape of a human body including two arms, two legs and a torso; and (b) an outer shell in the form of an elastic fabric that has the shape of a human body including two arms, two legs and a torso. The inner shell is constructed of an element-proof (usually waterproof) fabric. The inner shell and the outer shell can be optionally connected together at specific locations, for example, at the neck area, the two wrist areas and the two ankle areas. Hook and pile fasteners, element-proof zippers, or stitching or any other suitable joining system can be used for connection.

The inner shell preferably includes a neck seal, wrist seals, ankle seals and an element proof zipper to ease entry into the dry-suit. These seals prevent the elements, such as water, from contacting the skin of the wearer by entering the interior of the inner shell. However, it will be understood that wrist and ankle seals are not required if the element proof inner shell has integrated foot and hand covers. The inner shell is preferably made of a flexible waterproof material. The material of the inner shell can be an elastomeric material such as a coated fabric comprising nylon fabric with flexible polyurethane coating or a water impermeable but breathable membrane. Such inner shell materials can be neoprene, flexible polystyrene, latex, butadiene, polyvinyl or rubber. However, it is understood that any suitable elastomeric material can be used.

The outer shell is made of a flexible elastomeric material such as neoprene, polystyrene, latex, butadiene, polyvinyl, rubber or a stretchable fabric such as Lycra. Other types of suitable elastomeric materials can be used. In some cases, it is advantageous if the outer shell is water permeable so that any water that becomes trapped between the inner and outer shells can escape. The stretchable outer fabric provides abrasion resistance, thereby protecting the element-proof integrity of the inner shell. The outer shell is generally smaller in area than the inner shell and contracts the inner shell. In a preferred embodiment, the material used for the inner element proof shell is generally less elastic than the outer elastic shell. The seals are made of any suitable sealing material such as latex rubber but it is understood that the seals are not restricted to latex rubber. The inner and outer shells of one suit can be exchanged with other inner and outer shells of other suits to provide versatility. A supply of alternative inner and outer shells can be maintained for one set of shells.

The first and second materials can optionally be connected at the neck, wrist and ankle areas of the dry-suit. An advantage is that the inner shell can be thinner than traditional dry-suit shells because its main purpose is to create a barrier to the elements outside the shell. There is no need for the inner shell to be thick so that it is resistant to abrasion. The elastic outer shell is smaller in area size than the inner shell and by contraction gathers any loose material of the inner shell in random pleats thereby creating a smooth exterior form-fitting dry-suit. The elastic outer shell protects the integrity of the thin inner shell by resisting abrasion and tearing.

Figure 1:
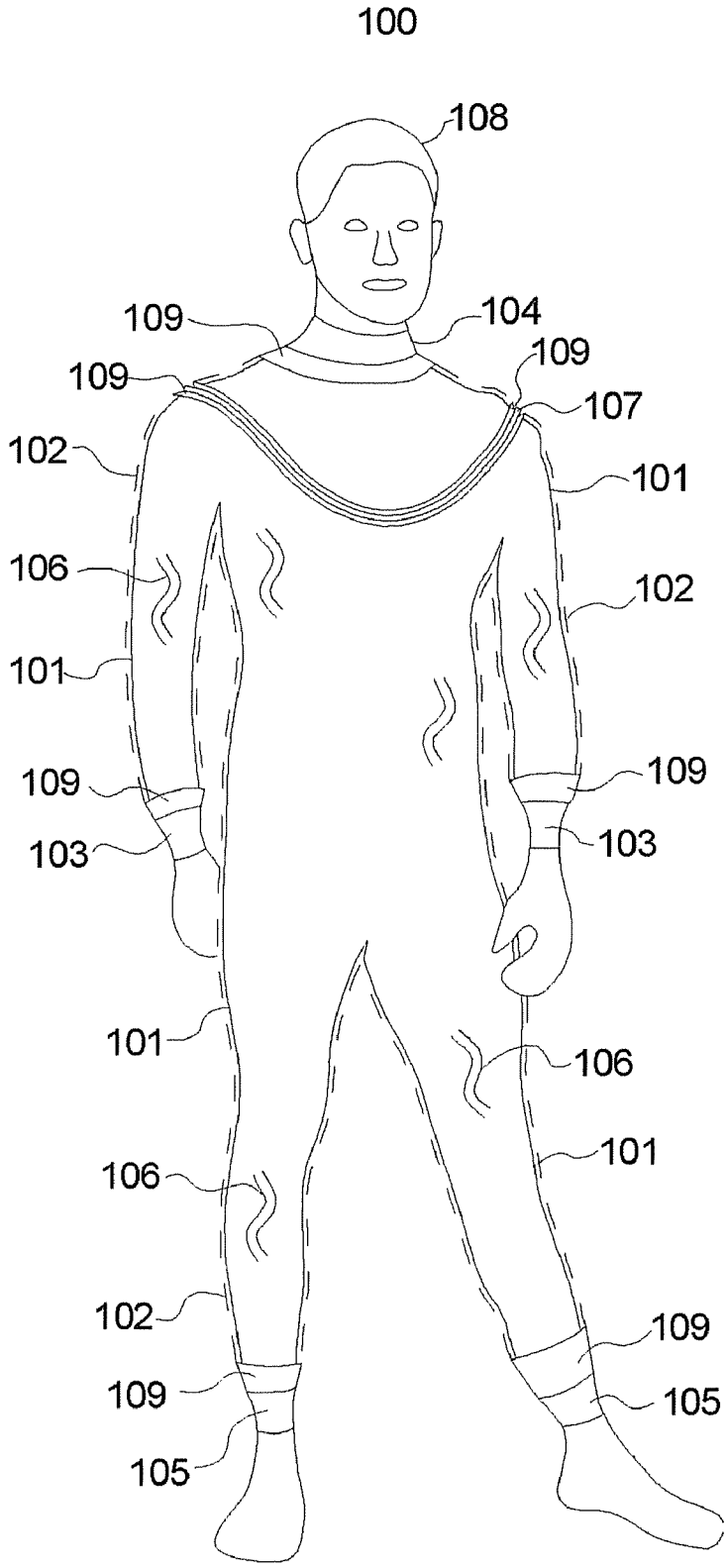
FIG. 1 illustrates an isometric frontal view of a person wearing a double layer dry-suit according to the invention.

Referring to the drawings, FIG. 1 illustrates an isometric frontal view of a user wearing the double layer dry-suit 100. The user 108 is shown wearing an element-proof inner shell 101 next to his body. The inner shell 101 is shown in solid outline. Inner shell 101 is preferably element sealed to the user's body with two wrist seals 103, two ankle seals 105 and a neck seal 104. These seals impede the elements, usually cold water, from entering the space between the body of the user 108 and the inner shell 101. Located below the front neck area 104 of the inner shell 101 is an arced waterproof zipper 107. The waterproof zipper 107, when open, assists the user's legs, arms and torso to enter the dry-suit 100 through the opening in the neck area that is sealed by the waterproof zipper 107. One such waterproof zipper is available from YKK Company in Japan.

The elastomeric outer shell 102, shown in dotted lines, is preferably smaller in area size than the area of the inner shell 101 and completely envelopes the inner shell. In a preferred embodiment, the outer shell 102 is 30 to 35 percent smaller in area than the inner shell 101. The outer shell 102 is preferably constructed of a resilient material which contracts to conform to the body of the user 108. In so doing, the outer shell 102 gathers the excess areas of the inner shell 101 into random pleats 106 as shown in the torso and neck areas of the user in FIG. 1. When a diver or swimmer puts on the dry-suit, the outer shell 102 contracts and compresses against the waterproof inner shell, thereby providing a smooth outer surface dry-suit. This smooth aspect reduces drag resistance in the water. Also, when the outer shell 102 contracts, it forces out air that is trapped in the space between the outer shell 102 and the inner shell 101. It also forces out excess air that is trapped between the inner shell 101 and the user's body. The absence of excess air inside inner shell 101 and between the inner shell 101 and the outer shell 102 eliminates or greatly reduces buoyancy and enables the diver or swimmer to submerge with less difficulty than with a conventional air containing dry-suit. This is important in activities such as surfing or free diving, where excess buoyancy is a hindrance. The outer shell 102 is preferably porous and fast drying. The outer shell 102 in a preferred embodiment is seamed or attached to the inner shell 101 at lamination points 109, namely the two wrist seals 103, two ankle seals 105 and at the zipper 107.

The waterproof zipper 107 shown in FIG. 1 is of a curved design and extends from the top of one shoulder and downwardly in a curved manner across the upper chest and ends on the top of the other shoulder. However, it is understood that the zipper 107 can have other configurations such as, for example, diagonally on the chest of the dry-suit or extending from the top of the sleeve of one arm and across the chest in a downwardly arced manner and then up to the top of the sleeve of the other arm. It is also understood that other suitable element-proof fastening means instead of a zipper can be used.

In an alternative embodiment, if desirable, the dry-suit 100 can be formed in two pieces as an upper section and a lower section. In such a two piece design, appropriate conventional element-proof seals such as water seals are built into the waist connecting points of the upper and lower sections.

Figure 2:
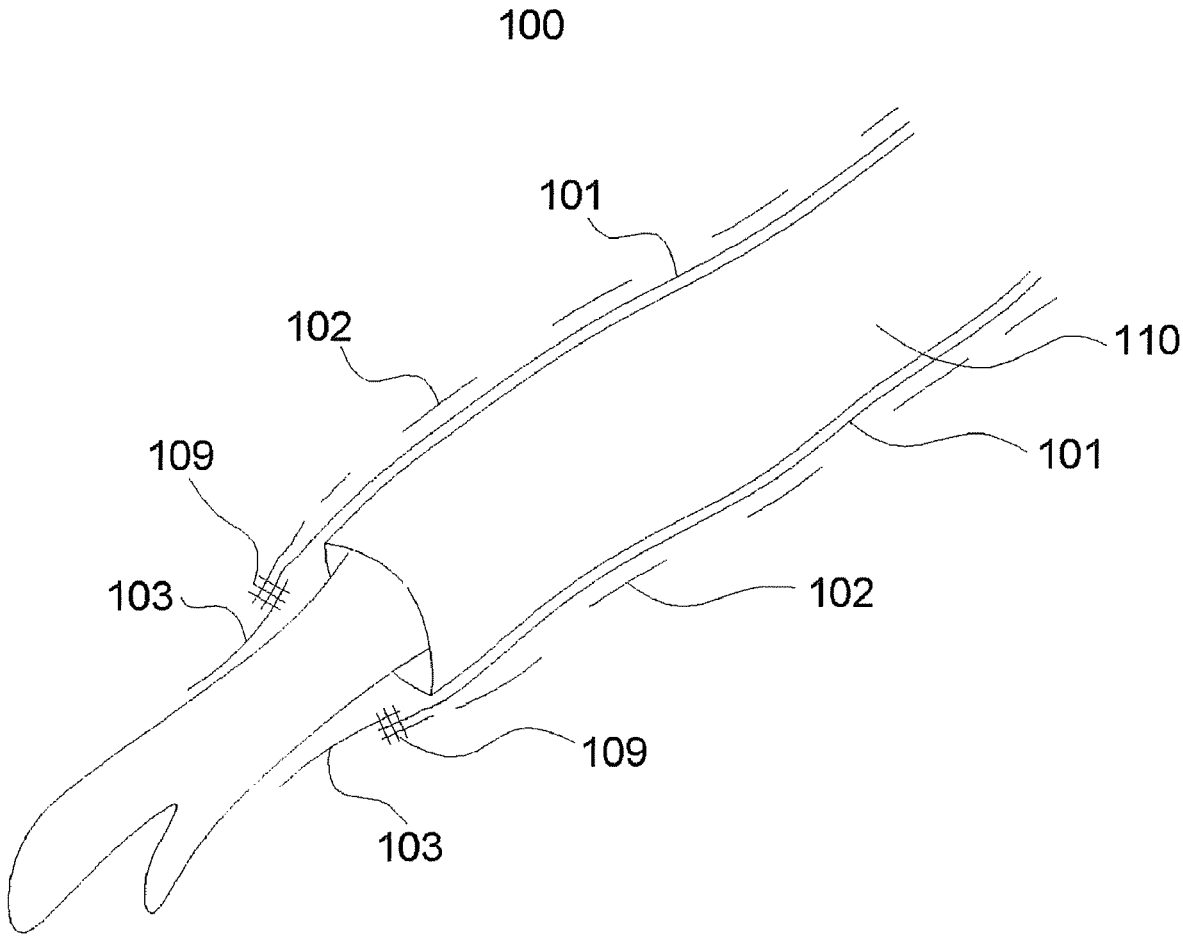
FIG. 2 illustrates a side cut away view of the arm of a double layer dry-suit according to the invention.

FIG. 2 illustrates a side cut away view of an arm of the user and the double layer dry-suit 100. A fleece under garment 110 is typically worn as a first layer over the body of the user to provide insulation from the cold. The element proof inner shell 101 is then worn as a layer over the fleece garment 110. A lamination seal 109 joins the end of the sleeve 101 to the wrist seal 103, which can be latex. The elastomeric outer shell 102 fits over the inner shell 101 as an outer layer and by contracting, compresses both the inner shell 101 and the fleece undergarment 110, thereby creating a form fitting hydrodynamic dry-suit. The end of the sleeve of the outer shell 102 is sealed by seal 109 to the inner shell 101 and the wrist seal 103.

FIG. 3A illustrates a section view of an inner material 101 and the interior side of a section of elastic outer material 102 with spatially disposed adhesive sites 111. FIG. 3B illustrates a section view of an elastic outer material 102 and an element-proof inner material 101 with spatially disposed adhesive sites 111. FIG. 3C illustrates a section view of an inner shell 101 and an outer shell 102 with spatially disposed adhesive sites 111 on the contacting surfaces of the inner shell 101 and the outer shell 102. The embodiments shown in FIG. 3 are options. As seen in FIGS. 3A, 3B and 3C, the inside of the outer shell 102, the outside of the inner shell 101 or the facing surfaces of the inner shell 101 and outer shell 102, can have an array of detachable sticky patches 111 silkscreened onto the shell 102. While spatially disposed patches are shown, it is understood that other arrangements of patches, or even solid area patches can be used. These sticky patches removably adhere the inner and outer shells together at key locations such as the seat and chest areas of the suit 100. For instance, if the double layer dry suit 100 is being worn by a surfer, the surfer wants his body and the dry-suit to have a grip on the top surface of the surfboard. He does not want the inner and outer layers in the chest area to shift relative to each other while he is on the surfboard. In such a case, the sticky patches 111 are applied to the chest area of the inner side of the outer shell 102. For divers, it may be advantageous to have the two layers of the buttocks area of the dry-suit sealed. In that case, the sticky patches 111 are applied to the buttocks area.

As mentioned above, the user 108 usually wears an insulating fleece garment under the inner shell 101. A problem with this arrangement is that the legs and sleeves of the fleece are pulled up when the user 108 pulls the dry-suit over the fleece. In practice, it has been found that to avoid this problem, the suit 100 should be turned inside out. In that way, it can be readily put on the body of the user 108. To put the suit on, the user 108 first extends one foot through the appropriate foot opening in the suit 100. The user 108 then extends the other foot through the other foot opening. Once the two feet are through the openings, the suit comprising both the inner shell 101 and the outer shell 102 is pulled up exterior side out over the legs, hips, and to the waist of the user 108. From there, the user 108 extends his arms through the interior of the respective arms of the suit and pulls the suit over his arms and torso. Finally, the suit 100 is pulled up over the shoulders, the neck portion found above the zipper 107 is pulled in place and the zipper 107 is closed. In this way, the undergarment fleece is not pulled up the legs of the user 108, which tends to occur if the user 108 attempts to put on the suit right side out rather than inside out.

The double shell concept according to the invention is versatile because it can also be used in a jacket, such as dry tops for kayaking or sailing, and pants, such as fishing waders or sailing pants. The double shell dry-suit can be combined with standard dry suits, for example, a double shell jacket can be worn with a conventional single layer neoprene dry-suit pant, or vice versa. The double shell suit according to the invention can also be used as an undergarment, for example, under work clothes or foul weather gear. Fishermen, and the like, find traditional survival suits bulky and cumbersome.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A double layer dry-suit for underwater diving or water surface activities, comprising:

(a) a first hollow inner water-proof flexible material formed in the shape of a human body including two arms with first wrist areas, two legs with first ankle areas and a torso with a first neck area, the first wrist areas, ankle areas and neck areas of the first material having seals that seal the dry-suit against the penetration of water into the interior of the dry-suit; and (b) a second hollow outer elastic material having an area that is smaller than the area of the first material and being formed in the shape of a human body including two arms with second wrist areas, two legs with second ankle areas and a torso with a second neck area, said second material with two arms and second wrist areas, two legs with second ankle areas and torso with second neck area overlying the two arms with first wrist areas, two legs with first ankle areas and torso with first neck area of said first material, and being free of any solid intermediate material between the first material and the second material and being able to move independently relative to the corresponding areas of the first material.

2. A dry-suit as claimed in claim 1 wherein the first flexible material is formed of flexible breathable polyurethane coated nylon fabric or flexible breathable waterproof nylon fabric.

3. A dry-suit as claimed in claim 1 wherein the first flexible material is formed of elastomer coated fabric, neoprene, flexible polystyrene, latex, butadiene, polyvinyl or rubber.

4. A dry-suit as claimed in claim 1 wherein the second elastic material is formed of neoprene, flexible polystyrene, latex, butadiene, polyvinyl, rubber, elastic fabric or Lycra fabric.

5. A dry-suit as claimed in claim 2 wherein the second elastic material is formed of neoprene, polystyrene, latex, butadiene, polyvinyl, rubber, elastic fabric or Lycra fabric.

6. A dry-suit as claimed in claim 3 wherein the second elastic material is formed of neoprene, polystyrene, latex, butadiene, polyvinyl, rubber, elastic fabric or Lycra fabric.

7. A dry-suit as claimed in claim 1 wherein the first and second materials are connected at the neck, wrist, and ankle areas of the dry-suit.

8. A dry-suit as claimed in claim 7 wherein the first and second materials are connected together by hook and pile fasteners, snaps, zippers, buckles, adhesives, magnets, folds, sewing or roll-ups.

9. A dry-suit as claimed in claim 1 wherein the elastomeric action of the second elastic material compresses the underlying first element-proof flexible fabric to provide a dry-suit with a smooth outer skin.

10. A dry-suit as claimed in claim 1 wherein the suit is formed in separate sections which are connected together.

11. A dry-suit as claimed in claim 10 wherein the separate sections are formed to fit the upper body and the lower body of a wearer of the dry-suit.

12. A dry-suit as claimed in claim 1 wherein at least one of the mating surfaces of the first material or the second material has adhesive thereon.

13. A dry-suit as claimed in claim 1 wherein at least one of the mating surfaces of the buttocks area or the chest area of the first material or the second material of the dry-suit has adhesive thereon to hold the first and second materials together in the buttocks area or the chest area.

14. A dry-suit as claimed in claim 13 wherein the second material facing the buttocks area or the chest area of the first material has thereon a spacial array of detachable adhesive sites.

15. A method of constructing a two-layer water-proof dry-suit for underwater diving or water surface activities comprising:

(a) preparing a first hollow inner water-proof flexible material in the shape of a human body including two arms with first wrist areas, two legs with first ankle areas and a torso with a first neck area, the first wrist areas, ankle areas and neck area having seals that seal the dry-suit against the penetration of water into the interior of the dry-suit;

(b) preparing a second hollow outer elastic material in the shape of a human body including two arms with second wrist areas, two legs with second ankle areas and a torso with a second neck area, said second material being of an area smaller than the area of the first material; and (c) overlying the second material on the first material with no intermediate material between the first material and the second material so that the two arms and first wrist areas, two legs and first ankle areas and torso and first neck area of the first material coordinate with the two arms and second wrist areas, the two legs and second ankle areas and the torso and second neck area of the second material, the first and second materials being independent of and free to move separately in relation to one another.

16. A method as claimed in claim 15 wherein the elastomeric action of the second hollow elastic material compresses the underlying first water-proof material to provide a smooth outer surface to the dry-suit.

17. A method as claimed in claim 15 wherein the first flexible material is connected to the second elastic material at the neck, wrist and ankle areas of the dry-suit.

18. A method as claimed in claim 17 wherein the neck, wrist and ankle areas of the dry-suit are fitted with detachable hook and pile fasteners.

19. A method as claimed in claim 15 wherein a waterproof zipper is secured to the upper torso area of the first and second materials of the dry suit.

20. A method as claimed in claim 15 including applying to the seat or chest area of the material facing surface of either the first material or the second material a detachable adhesive.

21. A dry-suit as claimed in claim 1 wherein the neck, wrist and ankle areas of the first and second material are laminated together.

22. A dry-suit as claimed in claim 1 wherein one or both of the wrist areas and ankle areas of the dry-suit have respective integrated hand and foot covers instead of the seals.

23. A dry-suit as claimed in claim 1 wherein the torso of the first and second materials has therein a waterproof zipper.

* * * * *